United States Patent [19]

Peschetz

[11] Patent Number: 4,515,542

[45] Date of Patent: May 7, 1985

[54] APPARATUS FOR THE PRODUCTION OF A RECONSTITUTED TOBACCO FOIL

[75] Inventor: Johann Peschetz, Enzersdorf an der Fischa, Austria

[73] Assignee: Austria Tabkwerke Aktiengesellschaft vorm. Osterreischische Tabakregie, Vienna, Austria

[21] Appl. No.: 627,658

[22] Filed: Jul. 3, 1984

[30] Foreign Application Priority Data

Jul. 5, 1983 [EP] European Pat. Off. ..... 83106530.5

[51] Int. Cl.[3] ..... B28B 1/26

[52] U.S. Cl. ..... 425/84; 162/4; 162/303; 162/336; 162/343; 425/85; 425/101; 425/223; 425/224

[58] Field of Search ..... 425/84, 85, 223, 224, 425/371; 264/87, 563, 565; 162/300, 303, 4, 317, 336, 345, 343; 210/400, 401, 406

[56] References Cited

U.S. PATENT DOCUMENTS

| | | | |
|---|---|---|---|
| 2,590,186 | 3/1952 | Land | 425/84 |
| 3,215,593 | 11/1965 | Green | 162/336 |
| 3,563,852 | 8/1967 | Rojecki | 162/303 |
| 3,578,558 | 5/1971 | McCarrick et al. | 162/303 |
| 3,810,817 | 5/1974 | Arledter | 162/303 |

FOREIGN PATENT DOCUMENTS

| | | | |
|---|---|---|---|
| 2152960 | 5/1972 | Fed. Rep. of Germany | 162/301 |
| 1426095 | 2/1976 | United Kingdom . | |

*Primary Examiner*—Jay H. Woo
*Assistant Examiner*—Mike McGurk
*Attorney, Agent, or Firm*—Pahl, Lorusso & Loud

[57] ABSTRACT

An apparatus for the production of reconstituted tobacco foil comprises a double sheet former with two movable endless screens in a y-shaped arrangement. A wedge-shaped box fills most of the space where the screens approach one another and with its upper side forms a reservoir for the aqueous suspension, from which the foil is precipitated.

7 Claims, 4 Drawing Figures

APPARATUS FOR THE PRODUCTION OF A RECONSTITUTED TOBACCO FOIL

The invention relates to an apparatus for the production of a reconstituted tobacco foil by precipitating from an aqueous suspension films consisting predominantly of tobacco particles, comprising two movable endless screens which approach one another in the film forming region, a wedge-shaped box being arranged between the screens and dehydrating means being provided beneath the screens in said region, wherein the screens subsequently extend parallel to one another and at a spacing small enough to combine the two films to a single foil.

The use of a double sheet former of this type has been described in our British specification No. 1 426 095. For the production of tobacco foils on an experimental scale the apparatus described there proved to be quite satisfactory. When the linear dimensions of the apparatus were increased in order to increase output the fluid above the screens tended to segregation and the finished foil showed irregularities. In addition the great amount of fluid above the screens lead to static problems. This situation was improved, when the angle between the screens was reduced and the intermediate space was essentially filled by increasing the size of the wedge-shaped box. In this manner the regions, in which the two films which constitute the finished foil, are completely separated from each other. As a consequence it seemed reasonable to feed the aqueous suspension from which the films are formed by precipitation directly into the gaps between the wedge-shaped box and the respective screens. It was found, however, that in this manner the two films showed differences. More important still, feeding the suspension into the narrow slot between wedge-shaped box and screen brought bubbles of air into the screen forming region, which destroyed the uniformity of each film.

It is an object of the invention to improve an apparatus of the described kind by providing means for feeding the aqueous suspension to both film forming regions at an equal rate and with uniform bubble-free consistency.

The invention achieves this task by providing that the upper side of the wedge-shaped box forms a reservoir limited by longitudinally extending side-walls with horizontal upper rim, conduits for the aqueous suspension leading into said reservoir.

With a construction of this kind the suspension fed into the reservoir formed by the upper part of the wedge-shaped box quiets down before it flows to the film forming regions in a completely uniform manner. It is particularly advantageous if the conduits for the suspension end within the fluid stored in the reservoir. To achieve a low degree of turbulence it is further advantageous to increase the inner diameter of the conduits in several steps in flow direction. A particularly uniform flow is achieved, if the conduits derive from a common horizontal supply pipe arranged inside of the wedge-shaped box. This provides also for optimal use of the space inside of said box.

The aqueous solution generally flows off the reservoir at the same rate at which it is fed into the reservoir. To avoid temporary increases limiting plates may be provided, the position of which determines a maximum flow.

If the outer surfaces of the side-walls of the reservoir are inclined towards the moving screens the fluid passes initially through a rapidly decreasing cross section and is, thus, strongly accelerated whereby the suspension achieves a homogeneous character, which is maintained until the films are formed. Immediately ahead of the film forming region there is a zone of constant cross-section sufficiently extended for flow stabilization, but not leading to renewed segregation.

Details of preferred embodiments of the invention will now be described, by way of examples, with reference to accompanying drawings, in which FIG. 1 is a diagram showing a side elevation through a sheet former.

Figure 1:
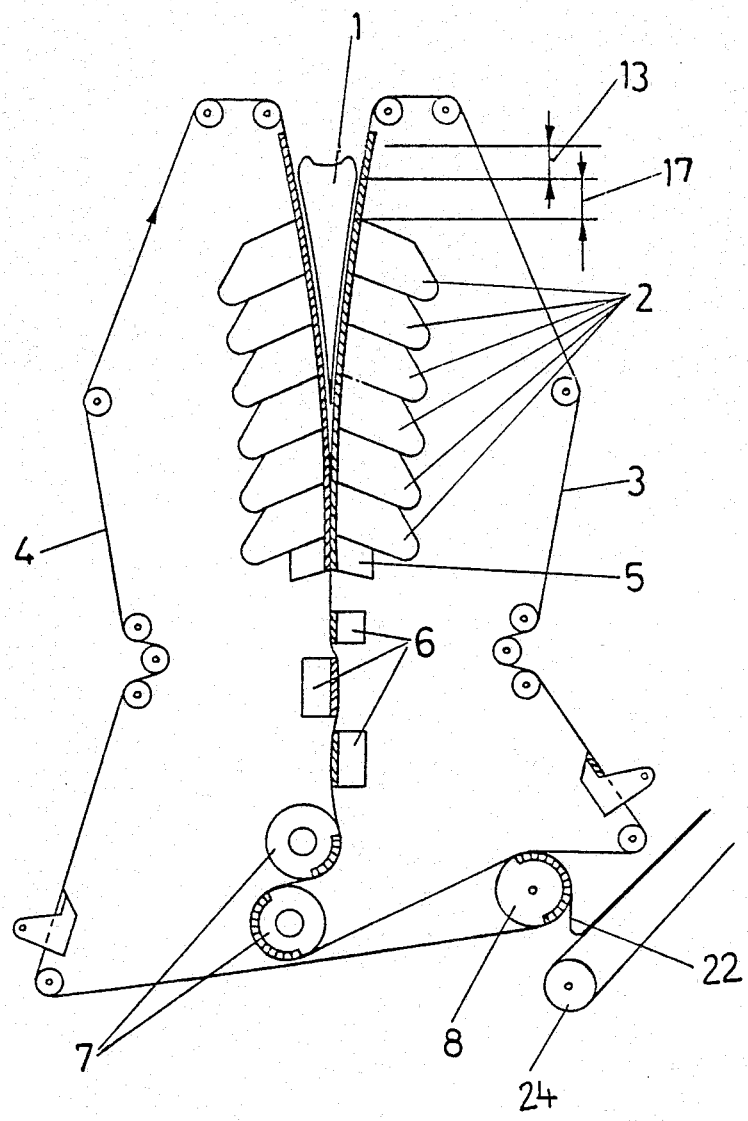
Figure 2:
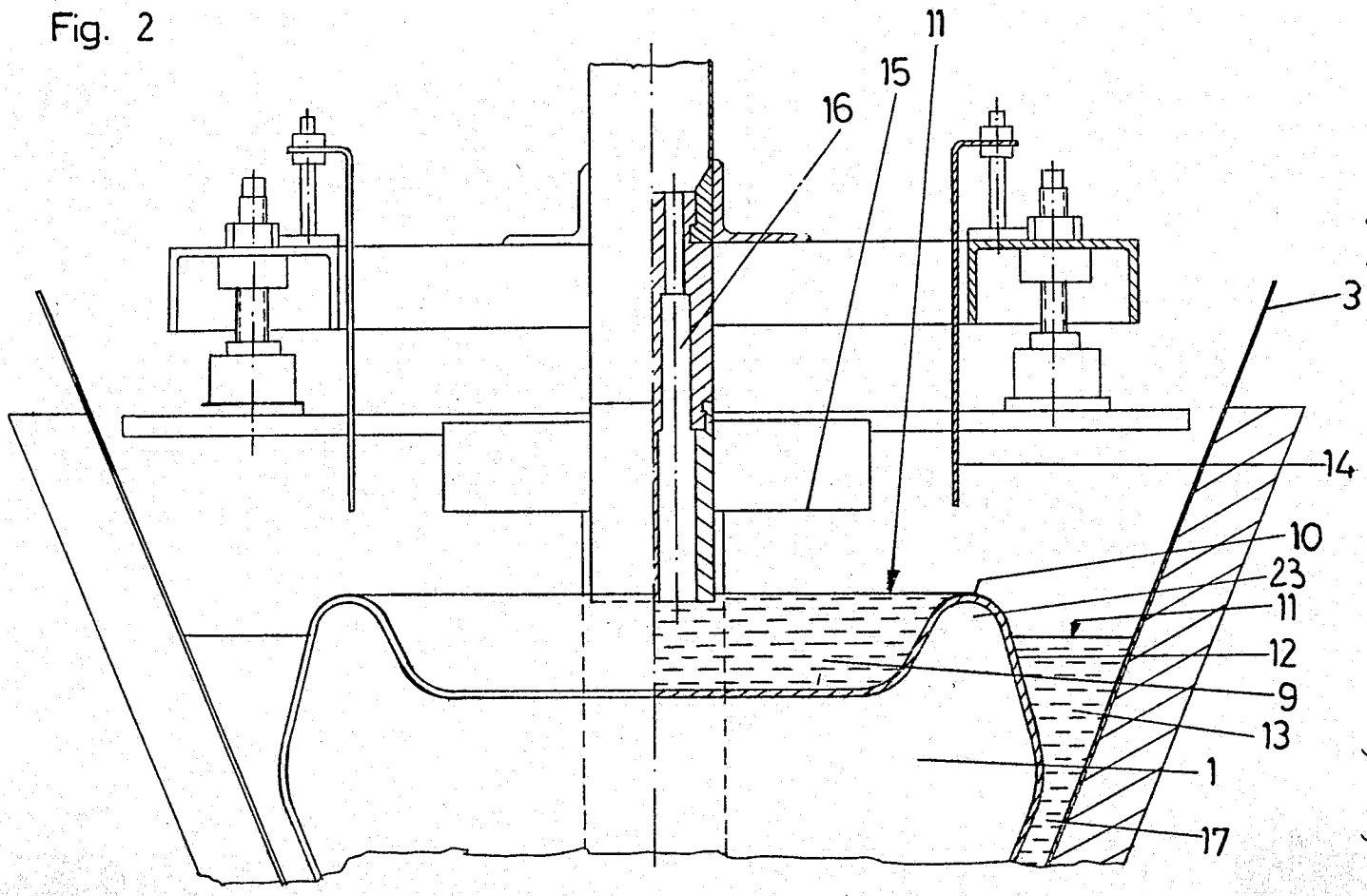
FIG. 2 shows the upper part of FIG. 1 enlarged and with the addition of means—not shown in FIG. 1—for supplying aqueous solution.

The apparatus shown in FIG. 1 serves for the production of a continuous reconstituted tobacco foil by precipitating comminuted tobacco waste and other particles on to moving screens 3 and 4. For this purpose the suspension, which is described in detail in British specification No. 1 426 095, is fed into a reservoir 9, which forms the upper part of a wedge-shaped box 1 and which is shown in more detail in FIGS. 2 to 4. The box 1 fills most of the space between the screens 3 and 4 in that region, where these screens approach one another. In the embodiments shown, the box 1 extends clearly above the film forming region, which is characterized by the presence of suction boxes 2. In this manner the suspension flowing over the rims 10 of the side-walls 23 limiting the reservoir 9 passes through a region 13, where acceleration takes place and where the suspension is well mixed, and through an additional zone 17, where the flow is stabilized before the formation of tobacco films begins.

In the film forming zone the converging screens 3 and 4 are supported by suction boxes 2, which are arranged immediately adjacent to each other. These suction boxes 2 are constantly filled with fluid, the pressure in these boxes may be controlled individually. The liquid part of the suspension flows continuously through the screens, whereas the screens retain progressively smaller particles of comminuted tobacco waste and thereby form a film or sheet. These two sheets are lead together before drying in order to form an inseparable foil.

A labyrinth seal 5 prevents fluid loss from the region where the screens 3 and 4 converge. A variable low vacuum is applied to said seal. For further dehydration the twin sheet enclosed between the screens 3 and 4 is lead over three alternately curved suction boxes 6. The vertical dehydration section ends in an S-shaped part characterized by suction cylinders 7. The reconstituted foil 22, which still has a 75% moisture content, is sucked onto the pick-up cylinder to remove it from the screen 3 and removed from the screen 4 by the action of a rotating cylinder 24. To obtain a final moisture content between 13 to 15% it moves to a dryer, which does not form part of the invention.

Essential for the invention and for the functioning of the described apparatus is the manner in which the suspension is fed to the regions, where the films or sheets which together constitute the finished foil, are formed. As shown in detail in FIG. 2 the conduits 16 for the suspension are diffusors, the internal diameter of which is increasing in steps. A number of such conduits is arranged in spaced relationship normal to the plane of the drawing. From the conduits 16 the suspension gets into a reservoir 9, which is formed by the upper side of the box 1. Care has to be taken that the upper rim 10 of the side-walls 23 is at a higher level than the exit of the conduits 16, because in this way the suspension is always added below the fluid level 11. The side-walls constitute a weir, over which the suspension flows to the acceleration zone 13 along the inclined surfaces 12. Acceleration takes place because the zone 13 has a downwardly diminishing cross-section. It is followed by a zone 17 of constant cross-section, where the flow of the suspension is stabilized.

In order to limit the fluctuation of the fluid level 11 in case of a decreased rate of consumption of the suspension or in case of its irregular supply an overflow edge 15 limits the fluid level. In addition the outflow of suspension from the reservoir 9 is controlled by limiting plates 14, the mounting of which may be vertically adjusted, which allows for a sufficiently small distance between the lower edge of the plates 14 and the upper rim 10 of the side-walls 23.

Figure 3:
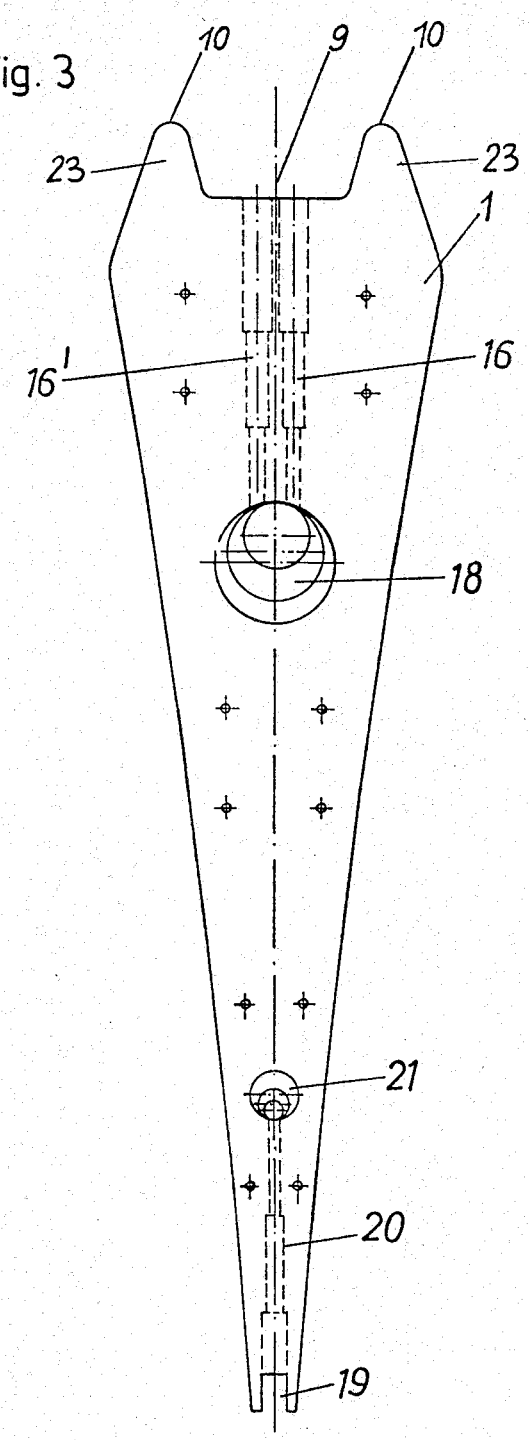
FIG. 3 shows a second embodiment of the wedge-shaped box.
Figure 4:
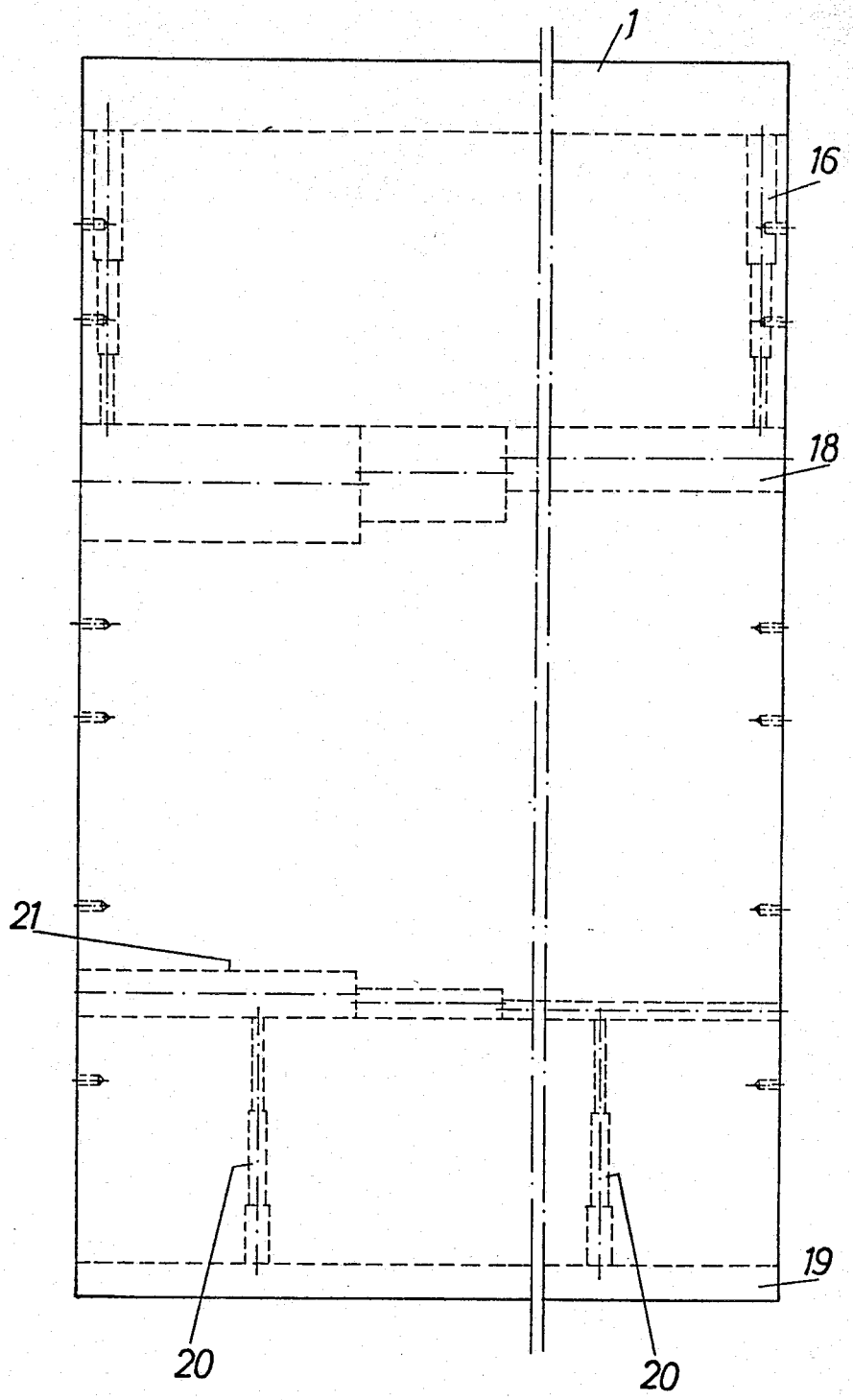
FIG. 4 is a side view of the embodiment shown in FIG. 3.

FIGS. 3 and 4 refer to an embodiment of the wedge-shaped box 1, in which the supply of suspension to the reservoir 9 limited by the side-walls 23 is particularly smooth. In this case a horizontal supply pipe 18 with gradually decreasing internal diameter is provided inside of the box 1. From this supply pipe 18 derive conduits 16 and 16', which have a gradually increasing diameter. These conduits 16, 16' feed the suspension of tobacco particles into the reservoir 9.

Inside of the wedge-shaped box 1 shown in FIGS. 3 and 4 there is a further supply pipe 21 of diminishing cross-section. From this supply pipe 21 derive conduits 20 with gradually increasing diameter in downward direction. These conduits 20 have their outlets near the region, where the two separate sheets are combined to a twin foil. A channel 19 distributes the suspension supplied by the conduits 20. This arrangement makes it possible to avoid a loss of the tobacco particles which pass into the uppermost suction boxes 2 together with a liquid part of the suspension. The fluid entering these suction boxes 2 is passed through the supply pipe 21 and the conduits 20 and is filtered by the films being formed where these have already sufficient density to retain also smaller particles.

What we claim is:

1. An apparatus for the production of a reconstituted tobacco foil by precipitating from an aqueous suspension films consisting predominantly of tobacco particles, comprising two movable endless screens which approach one another in the film forming region, a wedge-shaped box being arranged between the screens and dehydrating means being provided beneath the screens in said region, wherein the screens subsequently extend parallel to one another and at a spacing small enough to combine the two films to a single foil, characterized in that the upper side of the wedge-shaped box forms a reservoir limited by longitudinally extending side-walls with horizontal upper rim, and having conduits for conducting the aqueous suspension into said reservoir.

2. An apparatus according to claim 1, wherein the outer surfaces of the side-walls are inclined towards the moving screens.

3. An apparatus according to claim 1, wherein vertical conduits for the aqueous suspension end below the upper rim of the side-walls.

4. An apparatus according to claim 3, wherein the conduits for the aqueous suspension are branched from a horizontal tube which is arranged inside of the wedge-shaped box.

5. An apparatus according to claim 3, wherein the inner diameter of the conduits for the aqueous suspension increase stepwise.

6. An apparatus according to claim 1, wherein limiting plates are arranged in vertically movable fashion above the side-walls.

7. An apparatus according to anyone of the preceding claims, wherein additional conduits for conducting aqueous suspension lead into a channel extending along the lower rim of the wedge-shaped box.

* * * * *